United States Patent [19]

Atterby et al.

[11] Patent Number: 4,834,001

[45] Date of Patent: May 30, 1989

[54] BASE MEMBERS FOR PALLETS

[76] Inventors: Fred Atterby, Revviken, S-181 90 Lidingö ; Bertil Voss-Schrader, Korshamnsviken, S-139 00 Vädmö ; Lennart Tengqvist, Karlavägen 85, S-114 59 Stockholm, all of Sweden

[21] Appl. No.: 862,483

[22] PCT Filed: Sep. 13, 1985

[86] PCT No.: PCT/SE85/00346

§ 371 Date: May 8, 1986

§ 102(e) Date: May 8, 1986

[87] PCT Pub. No.: WO86/01786

PCT Pub. Date: Mar. 27, 1986

[30] Foreign Application Priority Data

Sep. 13, 1984 [SE] Sweden ..... 8404597
Oct. 12, 1984 [SE] Sweden ..... 8405115

[51] Int. Cl.[4] ..... B65D 19/00
[52] U.S. Cl. ..... 108/51.3; 108/51.1
[58] Field of Search ..... 108/51.3, 56.3, 901, 108/64, 56.1; 414/286; 206/599, 600

[56] References Cited

U.S. PATENT DOCUMENTS

| | | | |
|---|---|---|---|
| 699,495 | 5/1902 | Bechtel | 414/286 |
| 2,296,782 | 9/1942 | Fishcher et al. | 108/64 X |
| 2,444,183 | 6/1948 | Cahners | 108/51.3 |
| 2,728,545 | 12/1955 | Hermitage | 108/56.3 X |
| 2,930,481 | 3/1960 | Bebie | 108/51.1 X |
| 3,059,887 | 10/1962 | Ward, Jr. | 108/51.1 |
| 3,256,839 | 6/1966 | Peterson et al. | 108/56.1 |
| 3,464,371 | 9/1969 | Gifford | 108/51.3 |
| 3,601,067 | 4/1971 | Olsen | 108/51.3 |
| 3,650,225 | 3/1972 | Ball | 108/51.1 |
| 3,654,877 | 4/1972 | Barret | 108/56.1 |
| 3,659,534 | 5/1972 | Childs | 108/51.3 |
| 3,675,345 | 7/1977 | Abrams | 108/51.3 X |
| 3,881,429 | 5/1975 | Seymore | 108/51.3 |
| 3,952,672 | 4/1976 | Gordon et al. | 108/51.1 X |
| 4,140,295 | 2/1979 | Daley | 108/901 X |
| 4,467,728 | 8/1984 | Horne | 108/51.3 X |
| 4,494,897 | 1/1985 | Rogers | 108/51.3 X |
| 4,563,377 | 1/1986 | Melli | 108/51.3 X |

FOREIGN PATENT DOCUMENTS

| | | | |
|---|---|---|---|
| 575461 | 5/1957 | Canada | 108/51.3 |
| 0043253 | 1/1982 | European Pat. Off. . | |
| 0067087 | 12/1982 | European Pat. Off. | 108/64 |
| 2111135 | 9/1972 | Fed. Rep. of Germany | 108/56.1 |
| 2152859 | 4/1973 | Fed. Rep. of Germany | 108/51.1 |
| 612848 | 11/1926 | France | 108/51.1 |
| 141828 | 10/1965 | France | 206/600 |
| 2236741 | 2/1975 | France | 108/51.1 |
| 967876 | 10/1982 | U.S.S.R. | 108/51.1 |
| 709051 | 5/1954 | United Kingdom | 108/51.3 |
| 1163135 | 9/1969 | United Kingdom | 108/51.3 |
| 1580023 | 11/1980 | United Kingdom . | |

*Primary Examiner*—Kenneth J. Dorner
*Assistant Examiner*—José V. Chen

[57] ABSTRACT

Base member for pallets, especially for pallets of the type consisting of two or several base members, optionally provided with recesses for the forks of a fork lift truck, having a number of holes perpendicularly to their length direction, distributed along and at a minor distance from the upper surface of the base member or at the same surface, through which tubes can be inserted under a minor friction so as to unite the base members with each other to the formation of the pallet. The invention is characterized in that the base member is constituted of a pressed and folded wrapping (11) which after folding forms at least the essential outer surfaces of the base member (5, 6, 7, 12) and that stiffening inserts (a–f, 13–23, 31, 34) are present in an essential part of the inner space of the folded wrapping, also above the recesses for the forks of a fork lift truck, which inserts are bonded to the wrapping.

5 Claims, 6 Drawing Sheets

BASE MEMBERS FOR PALLETS

The present invention relates to especially advantageous base members which can be used for pallets consisting of two or several base members provided with a number of holes at the upper load-bearing horizontal surface thereof or at a minor distance therefrom, through which tubes are inserted under friction so as to unite the base members to the formation of the pallet. The suitably round tubes do not require a specific fixation in the base members and are retained in their position due to the friction and the so-called drawer-effect; the friction is considerably increased under load.

The base members according to the invention can, however, also be united with each other by attaching a plane of a suitable material (board, plywood, etc.), e.g. by gluing, on the upper horizontal surfaces of the base members, in which case the above-mentioned holes are not required or are not used. This plane then forms the load-bearing plane. With the use of tubes for uniting the base members the load-bearing parts of the pallet are the upper parts of the tubes and the upper surfaces of the base members in combination. If so is desired or required in view of the nature of the goods which the pallets are intended to bear, the pallets with cross-wise tubes can be provided with one or more plates adapted to the space between the base members which form a smooth and continuous load-bearing plane.

A pallet of the type described above is described in the Pat. No. WO83/03238, which is incorporated herewith as a reference. According to the said patent it is intended to achieve a pallet which can be handled by forks from four sides, consisting of at least two base members provided with holes near the upper load-bearing surface and with recesses in the lower part, intended to receive the forks of a conventional fork lift truck, which pallet has a very low weight, is cheap, has a great flexibility as regards adaptation for different purposes, is not bulky during storage (since it can be stored in a non-assembled condition in the form of separate parts) and, if so is desired, can easily be destroyed after use by burning without formation of toxic or otherwise disturbing gases. This pallet can be handled and moved by a fork lift truck from all four sides; the forks can be introduced below the tubes from two sides and through the recesses in the base members from two sides, which is required for rational handling and storage of goods.

The present invention relates, as has been mentioned above, to especially advantageous specific forms for base members of the type in question. The base members according to the invention are, in comparison with previously known base members, extremely cheap when manufactured in great quantities and have a very low weight with a fully sufficient load capacity so as to fulfil common requirements.

According to the invention a base member for pallets is achieved, especially for pallets of the type consisting of two or several base members, optionally provided with recesses for the forks of a fork lift truck, having a number of holes perpendicularly to their length axis, distributed along and at or at a minor distance from the upper surface of the base members, through which tubes can be inserted under a small friction so as to unite the base members with each other to the formation of the pallet. The base member according to the invention is characterized in that it is built up of a pressed and folded wrapping (11), which after folding forms at least the essential outer surfaces (5, 6, 7, 12) of the base member and that stiffening inserts, a–f, 13≅23, 31, 34, are present in an essential part of the internal space in the folded wrapping, also above the recesses for the forks of the fork lift truck, which inserts are bonded to the wrapping.

It is preferred that the vertical surfaces of the base member are parallel with each other and thus the inserts are then parallelepipedic and bonded to the opposite inner surfaces of the wrapping. So as to increase the diagonal stiffness of the inserts they may, when extra stiffness is required, be provided with interacting, diagonally arranged stiffening cross supports 29 inserted therein.

The inserts may be integral, i.e. be a continuation of the wrapping material, or separate, i.e. prefabricated before the insertion in the base member when the same is folded.

The invention is elucidated in detail below in connection with the preferred specific forms with reference to the enclosed drawings, wherein:

FIGS. 1*a* and *b* shows pressed carton laminate work pieces for the wrapping for base members according to the invention; FIG. 1 *c* shows the composition of the laminate (3 layers of carton) and two glue tongues on the wrapping glued to each other;

FIGS. 2*a, b, c* and *d* show in perspective stiffening and load-bearing inserts in a base member according to the invention;

Figure 5:
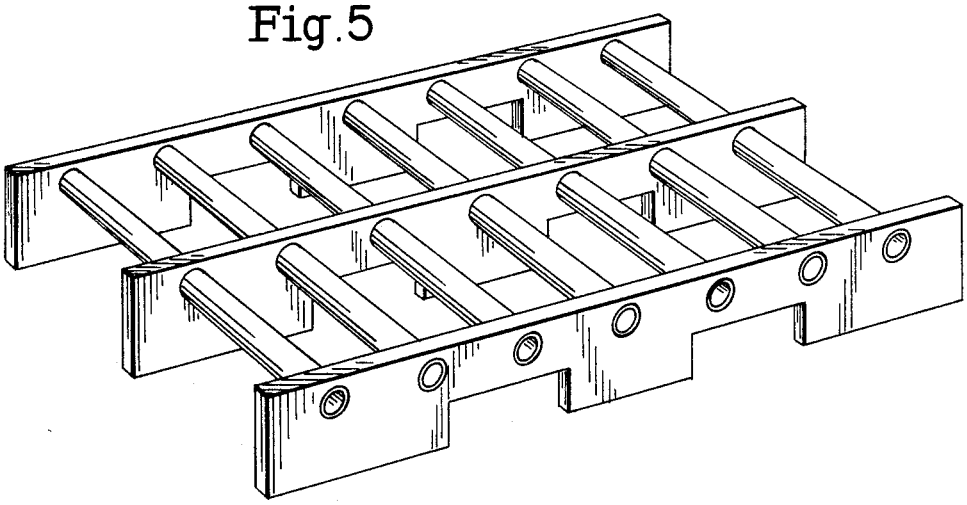
Figure 6:
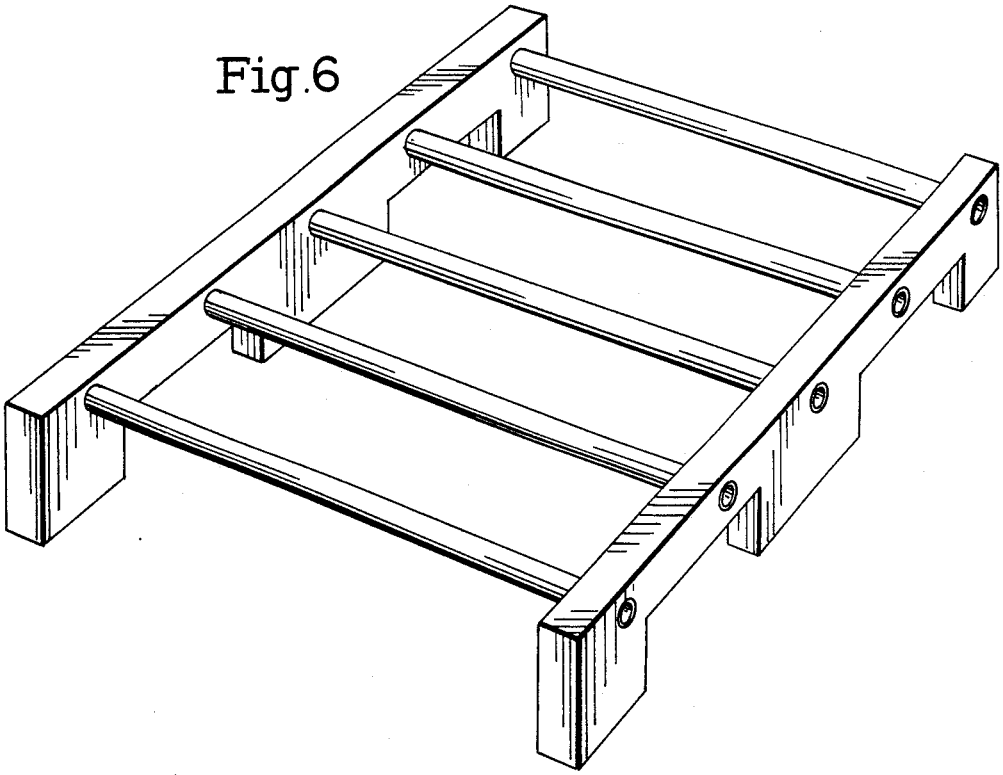
Figure 7A:
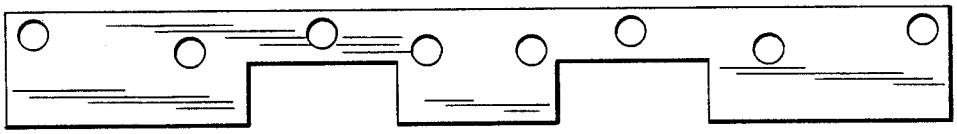
Figure 7B:
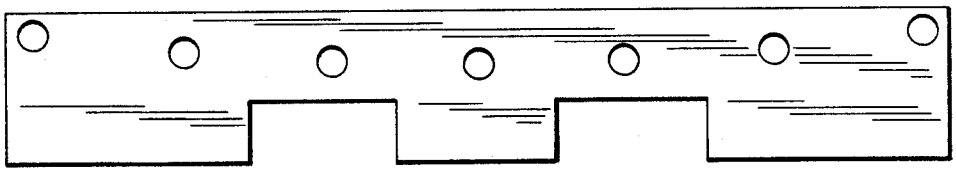
Figure 8A:
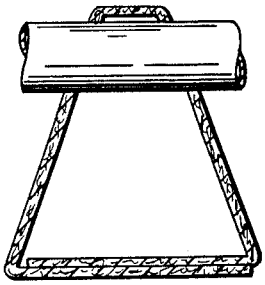
Figure 8B:
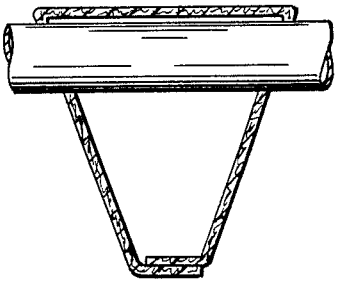
Figure 9A:
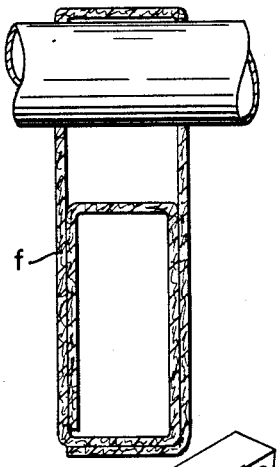
Figure 9B:
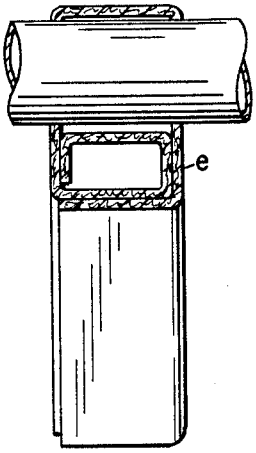
Figure 10:
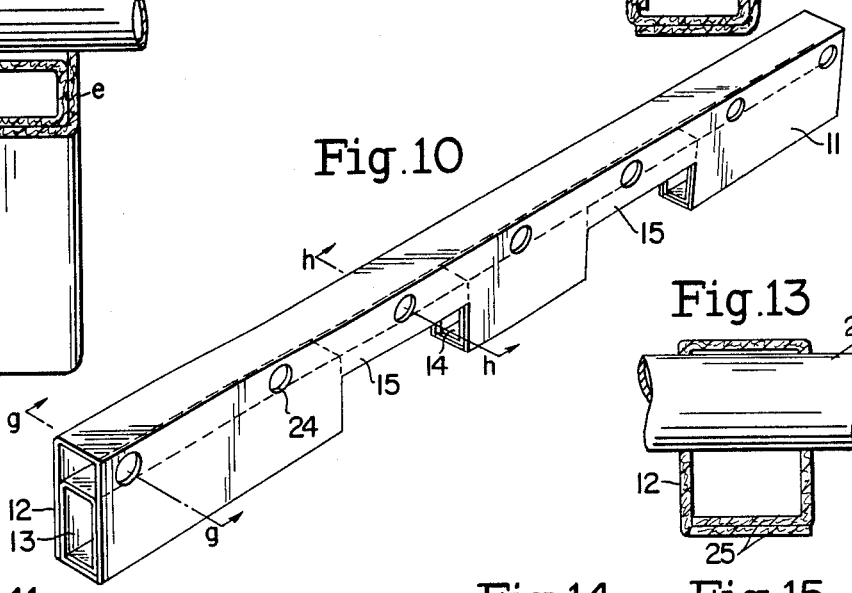
Figure 13:
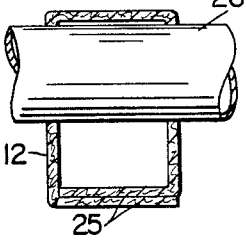
Figure 11:
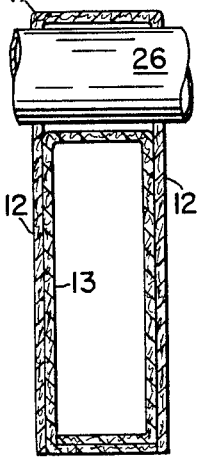
Figure 12:
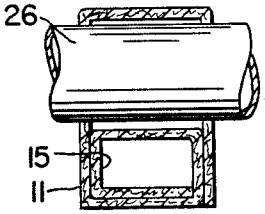
Figure 14:
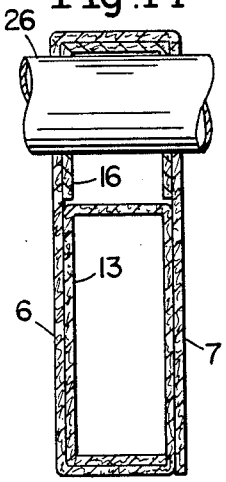
Figure 15:
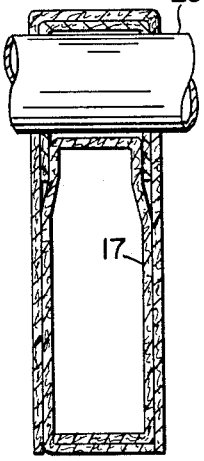
Figure 16:
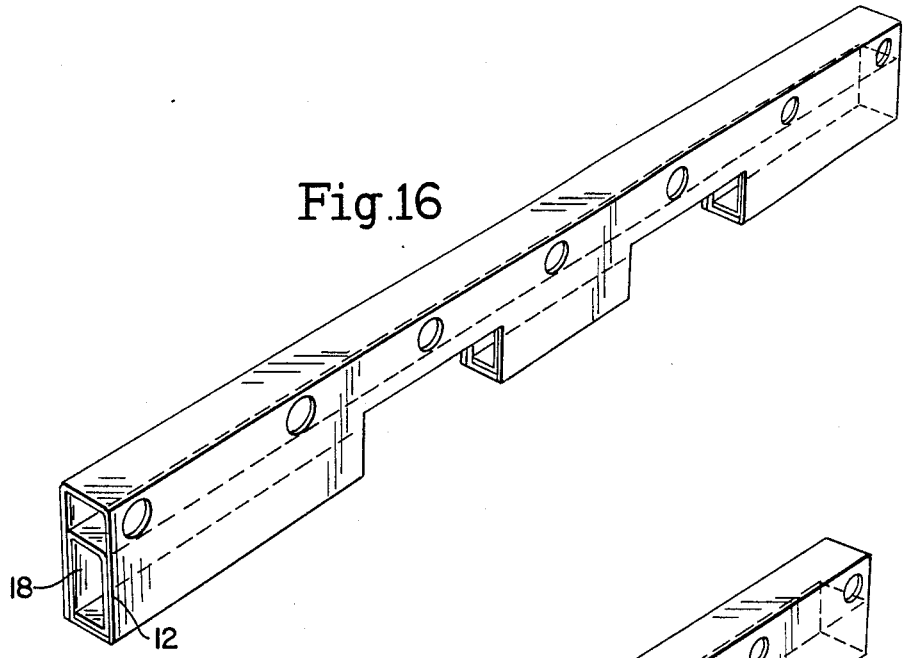
Figure 17:
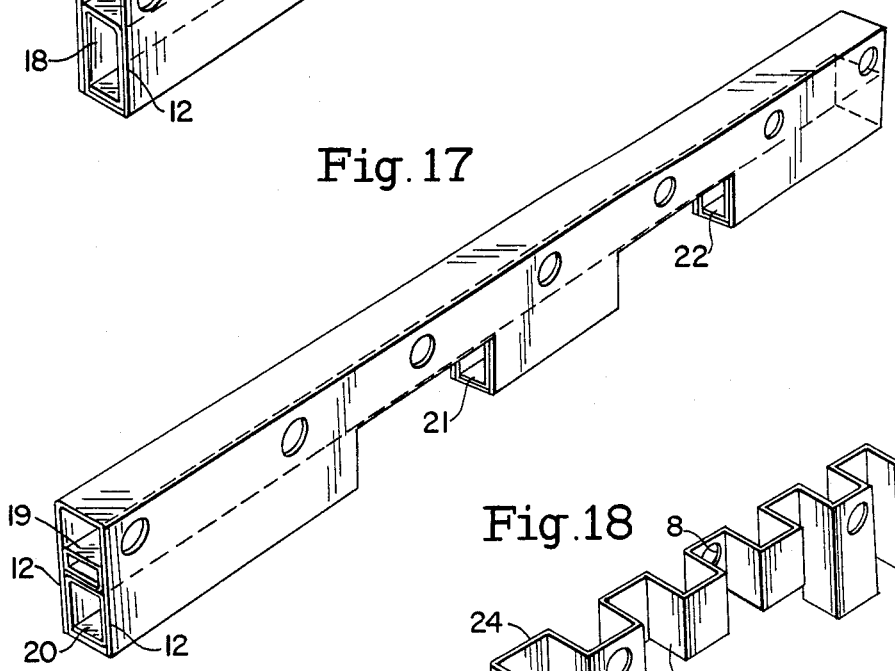
Figure 18:
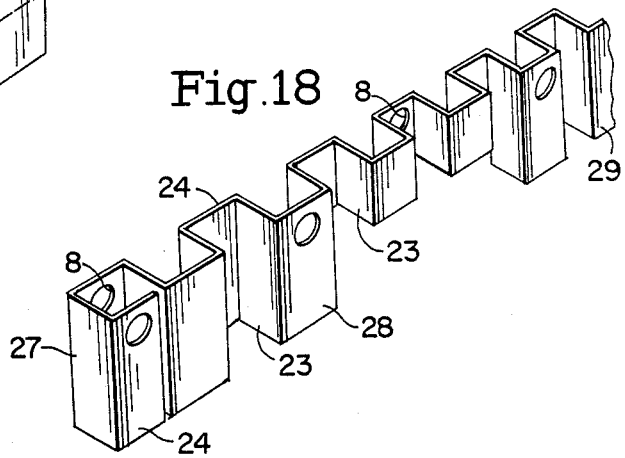
Figure 19:
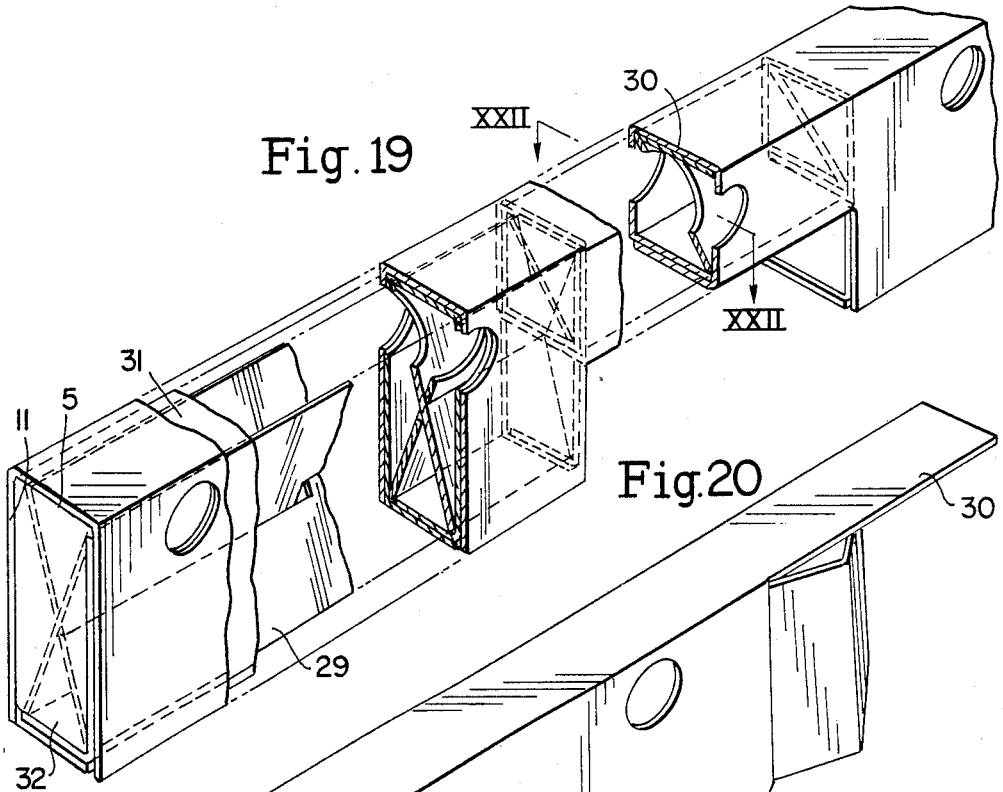
Figure 20:
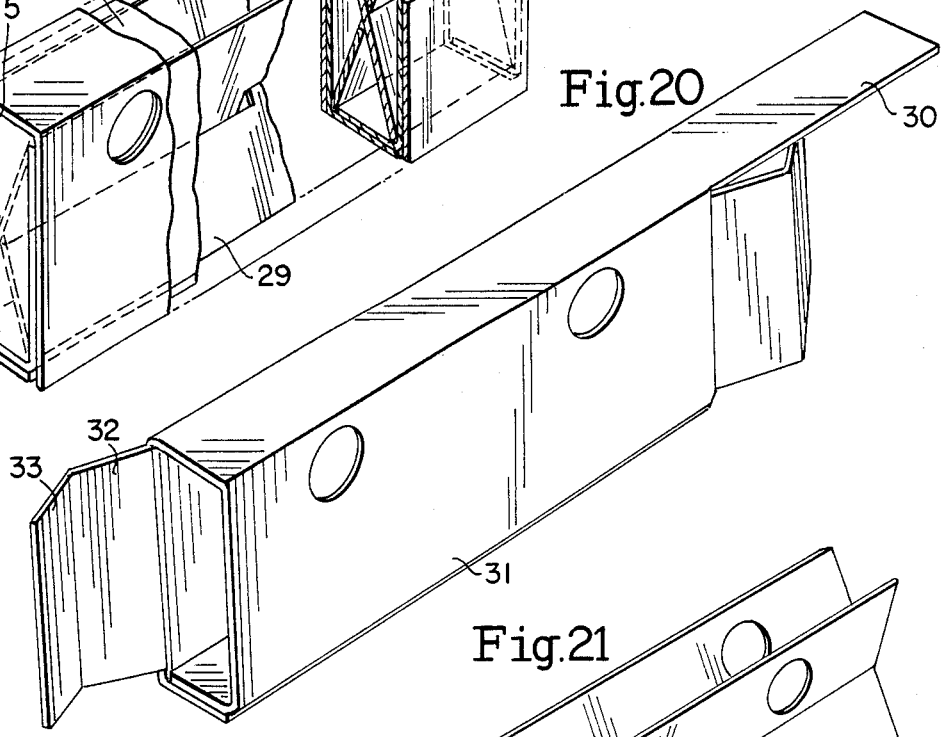
Figure 21:
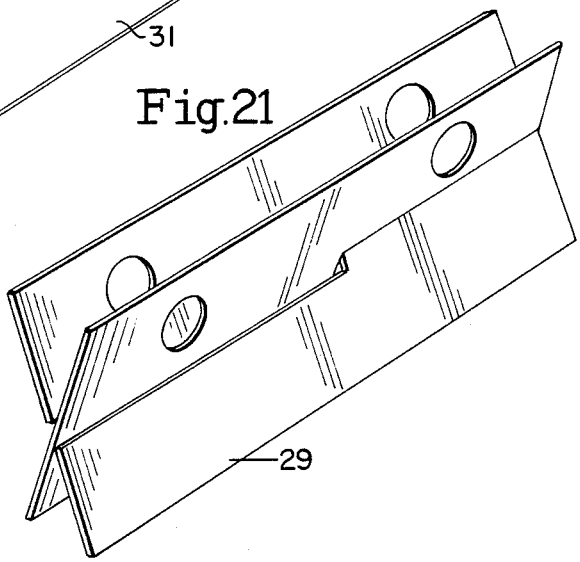
Figure 22:
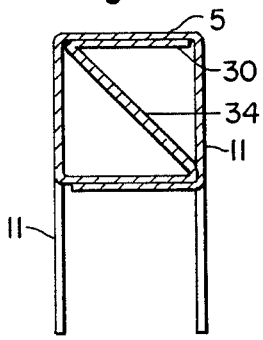

FIG. 5 a finished complete pallet in perspective provided with cross-wise tubes;

FIG. 6 shows a so-called half-pallet in perspective;

FIGS. 7*a* and *b* show diagramatically base members provided with holes an alternative localization;

FIGS. 8*a* and *b* shows cross-sections of base members differing from the rectangular one according to the previous figures;

FIGS. 9*a* and *b* show cross-sections of a base member wherein the separate inserts have been replaced with integral inserts indicated by e and f;

FIG. 10 shows a specific form of a base member according to the invention;

FIG. 11 shows a cross-section in the plane g in FIG. 10;

FIG. 12 shows a cross-section in the plane h in FIG. 10;

FIG. 13 shows an alternative embodiment for the cross-section in the plane h in FIG. 10;

FIG. 14 shows a cross-section of a base member similar to the one in FIG. 10 in the same location as the plane g but provided with a reinforcement glued to the wrapping covering the backbone of the base member and the surfaces therefrom towards and past the holes;

FIG. 15 shows an, in relation to FIG. 14, alternative embodiment;

FIG. 16 shows an embodiment wherein all inserts have been united to one single insert, provided with recesses for forks;

FIG. 17 shows an embodiment containing an insert running along the whole length of the base member, between the holes and the recesses for forks as well as lying inserts in the spaces there below;

FIG. 18 shows an alternative type of insert;

FIG. 19 shows a preferred alternative construction of a base member according to the invention;

FIG. 20 shows the insert in the outer end of the base member shown in FIG. 19, in a partly not glued condition;

FIG. 21 shows a specific form of the above-mentioned diagonally stiffening cross-supports optionally introduced into the inserts;

FIG. 22 is a cross-section of the part of the base member according to FIG. 19 which is above the recesses for the forks.

The base members according to the invention are constructed from one or more web-formed materials preferably a fibrebased material such as carton. The invention is elucidated below with reference to a preferred web-formed material, i.e. polyethylene coated carton with a thickness of about 0.3–0.4 mms, but is not at all restricted thereto; alternative web-formed materials are obvious to the expert, e.g. solid board and folding board. Such materials shall have a suitable rigidity and strength and should be able to be pressed, folded and glued. The material shall preferably have at least a certain degree of wet strength Several layers of the above-mentioned polyethylene coated carton are glued to each other to the formation of a composite material. 2–8 carton layers with intermediary glue layers can be used, preferably 3–5 layers. The so constructed composite material has a great stiffness but can still be pressed and folded. It is preferred in certain instances that the different layers in the laminate are pressed separately and covered with glue as required, whereupon the composite material at a considerably increased temperature, at which the glue or the adhesive substance does not bind, is bent to the intended form, whereupon the temperature is decreased for gluing together of the different layers. This procedure is especially advantageous when a great number of layers are used in the laminate The number of layers in the laminate is of course adapted to the mechanical stresses the finished base member is intended for.

Suitable glue products which admit a rapid gluing, are commercially accessible. Thermoplastic glues can be used, e.g. in the emulsion form, optionally supported with chelate formers or glues of the so-called hot melt type.

Figure 1A:
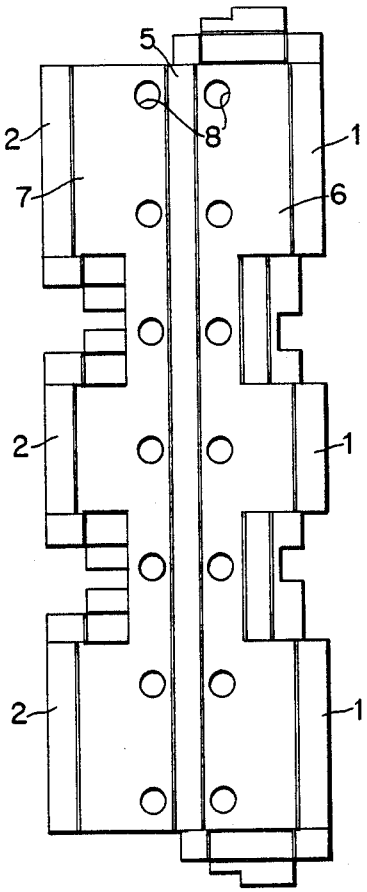
Figure 1B:
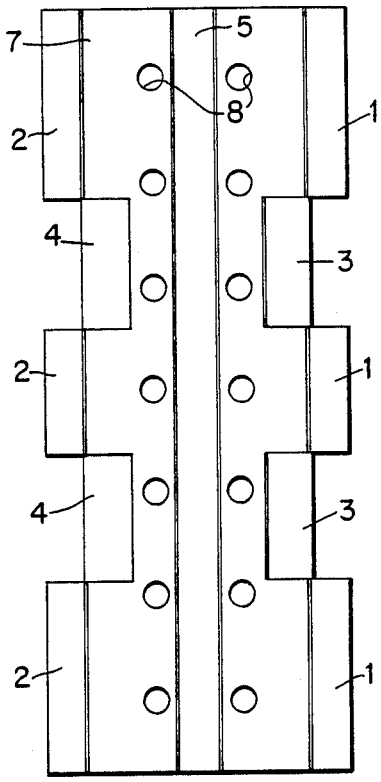
Figure 1C:
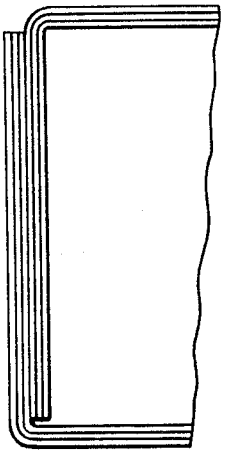
Figure 2A:
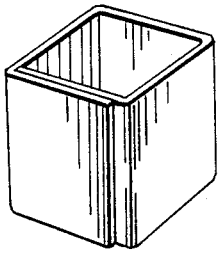
Figure 2B:
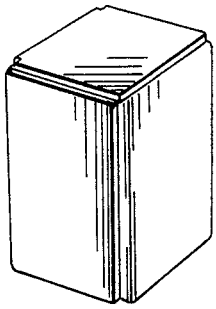
Figure 2C:
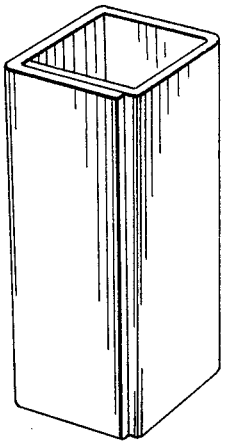
Figure 2D:
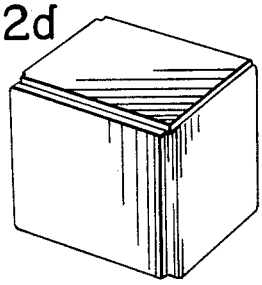

The separate layers in the laminate for the base members or alternatively the finished carton laminate are pressed to the intended form, for instance the form shown in FIGS. 1*a* or *b,* which is a wrapping for a base member. The wrapping is folded along the folding lines in FIGS. 1*a* or *b* (double lines). The wrapping shown in FIG. 1*a* is provided with glue tongues over-lapping each other and in this case all the openings in the finished base members are covered except the openings for the tubes. It should here be noted that certain openings of course can be tolerated in the finished base member without a resulting decreased strength It should also be understood that certain openings may by necessity be tolerated for manufacturing-technical reasons. A study of the embodiments according to the drawings makes it clear which tongues should be glued to each other, e.g. 1 to 2. In FIG. 1*b* a wrapping is shown which contains a lesser number of glue tongues. On this wrapping tongues 1 are glued to tongues 2; tongues 3 to tongues 4; in this case vertical surfaces which are rectangular to the length direction remain open but can be covered by inserts as indicated above. Alternatively, glue tongues are not used but the side surfaces of the base member wrapping are glued directly to the inserts as is elucidated further by FIGS. 10–17 and 20.

A finished base member according to the invention contains inserts. These inserts will strengthen the wrapping and give it the required rigidity and load-bearing capacity. The inserts can consist of any material which gives the folded wrapping these properties and can be attached thereto. The material for the inserts shall of course suitably be cheap and have a low weight. The preferred material for the inserts is the above-mentioned carton laminate, which also preferbly is used for cross-supports when such are used.

When a maximum strength is desired the inserts will preferably fill the whole empty space within the folded wrapping for the base member, suitably except a minor part thereof near the holes for the tubes, which suitably is provided with a material which gives friction between the base member and the tubes. For lower loads the number of inserts can be decreased stepwise, which gives economical advantages. The base member (the pallet) can thus easily be adapted for different desired purposes. The inserts can optionally be so attached to the wrapping that they will press against the introduced tube in which case the inserts at least partly gives the required friction between the base member and the tubes.

FIG. 2 shows finished (premanufactured) inserts of four sizes or forms, indicated by a, b, c and $d_1$ prepared of the above-mentioned carton laminate. The inserts a and c consists of pressed and/or cut rectangular pieces with four cross-wise folding lines which after folding and gluing of the over-lapping tongues form rectangular inserts for the inner part of the base member wrapping with the two openings directed upwards and downwards for maximum strength. The inserts b and d have also over-lapping tongues which, when glued together, cover the upper opening. These inserts have suitably a width equal to the distance between the inner surfaces of the folded wrapping, a length and a height so adapted that the inserts essentially fill the inner space of the folded wrapping length-wise and height-wise except possibly at the holes for the tubes where space can be left for material giving friction against the tubes.

Figure 3:
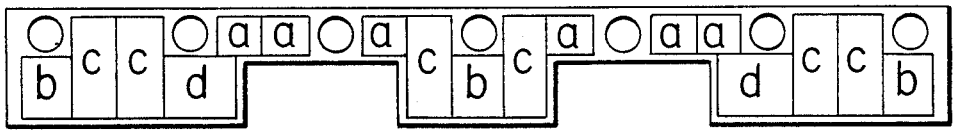
FIG. 3 is a side view of a base member with the positions for the load-bearing inserts a, b, c and d indicated.

In FIG. 3, which is a side-view of a base member, the positions for the inserts a–d are indicated, which in this instance in the preferred manner fill essentially the whole inner space of the base member except the space closest around the holes. It should be noted that the inserts b and d should be so located that their ends closed with tongues glued together are located towards the holes for the tubes. The reason therefor is partly to increase the strength of the base member directly below the tubes and partly that the tongues glued together forms a limit when material giving friction is introduced therein.

Figure 4:
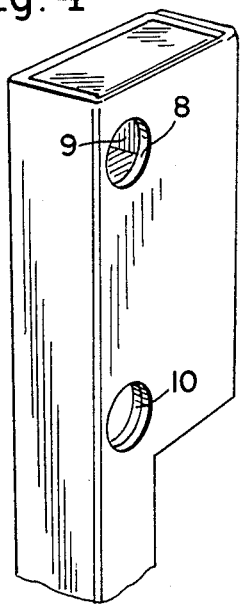
FIG. 4 shows in perspective a part of a folded base member wherein the space (9) around a hole (8) for tubes has been provided with a plastic foam filling (10)

FIG. 4 shows a part of a finished base member with holes 8 for tubes, the space 9 around one of them having been filled with a friction material 10, the second hole 8 having no such filling. The space for the friction material is delimited partly by the inner surfaces of the wrapping and partly of the inserts. It is desired to give this space a relatively small volume, above all for cost reasons. For this reason all inserts (b and d) below the holes have a closed surface towards the hole space 9.

The friction material is preferably a plastic foam such as polyurethane foam with a density suitably within the range 50–100 kg/m$^3$. Such a foam can be introduced in the space 9 through the opening for tubes, a mould plug being inserted therein. The openings for tubes in the wrapping has suitably a diameter which admits easy introduction of the tubes, whereas the mould plug inserted in the openings for the tubes during the introduction of the plastic foam has such a diameter that the hole in the plastic foam 10 has a diameter which is slightly less than the outer diameter of the tubes, e.g. 0.1–2.0 mms lesser depending on the desired friction. In this manner friction between the tubes and the base member is achieved.

The mould plug used during the insertion of the plastic foam can be made conical and/or be coated with oil so as to facilitate its extraction and the insertion of a tube therein and consists optionally of a material to which the plastic foam does not adhere such as Teflon®.

It is of course also possible not to use a mould plug when the plastic foam is introduced, in which case both tube openings in the folded wrapping are closed in a conventional manner and after insertion of the foam holes are cut therein having the desired diameter.

A further possibility to fill the space 9 around the holes for the tubes, which is delimited by the inserts and the base member wrapping with a friction material 10, 24, is to premanufacture inserts with finished holes giving the desired friction against the tubes. A material which can be used for such pre-manufactured inserts is polystyrene, suitably with a density of 25–50 kg/m$^3$. Another material is polyurethane with a similar or somewhat higher density. Such inserts can be introduced in and optionally attached to the wrapping together with the inserts a–d above or introduced in the holes after the folding of the wrapping.

However, friction surfaces can also be achieved between tubes and the wrapping without any added foam material, e.g. with inserts introduced in the holes of the wrapping, e.g. in tubular form, which are fixed in the holes and the inner surface thereof giving the intended friction. Optionally, the tubes can be provided with the required friction against the base member by deforming the outer ends of the tubes after assembling the pallet (to a conical form); also, the surface of the base member above the tubes can be deformed, e.g. by pressing a tongue towards the tube or in the same. Such pressed tongues are, however, preferably arranged horizontally on the side surfaces of the base members at the holes for the tubes, in which case laminate is left when the wrapping is pressed which forms such tongues. When the tubes are introduced into the hole these latter tongues are springingly bent sidewise and give the required friction.

It is thus obvious that friction can be achieved in many different manners and not solely by using a springing foam material with a hole of a lesser diameter than the diameter of the tubes. For this purpose premanufactured inserts can be used having holes which are not strictly circular or in general have not the same form as the tubes which admits introduction of the tubes therethrough under a controlled desired friction. Optionally, it is also possible to before or after the introduction of the tubes treat the same and/or the inserts with a friction-forming agent in the form of a paste, a liquid or a spray or even an agent which gives a gluing effect even if this normally not is desired or intended.

All of the above specifically mentioned methods are known to the expert and it is completely within the scope of his knowledge to find other methods for achieving the intended friction.

In this context it should be pointed out that friction between base members and tubes must not be especially great. In practice it has been found that already at a very minor friction or none at all it is difficult to disassemble one single tube from the complete pallet without the use of a jig for fixation of the base members in an exact position. This depends on the solid locking caused by the many contact surfaces between base members and tubes as soon as a tension in the pallet is caused during handling when a minor deformation always occurs. Further, the load contributes to the fixation of tubes and base members to each other. This information clarifies the importance of the friction between base members and tubes and that a solid fixation between the said parts is not desired. A solid fixation, e.g. a mechanical locking is too easily destroyed by chocks, e.g. caused by fork lift trucks. Flexibility is thus desired.

FIG. 5 shows in perspective a finished fullsize pallet assembled with the use of base members according to the invention, consisting of three base members and seven tubes.

Structural strength calculations and practical tests have shown that a considerable amount of material and thus costs can be saved if the inserts are constructed in a special manner in which material is concentrated to such places on the base member where the stresses are the greatest. In this way the weight of the base member (and thus the weight of the pallet assembled therewith) can be diminished with maintained or increased load-bearing capacity).

The specific forms elucidated in the drawing FIGS. 10–21 are simplified in relation to those shown in the drawing FIGS. 1–9, since they lack the specific glue tongues 1–4 or corresponding. This will lead to a simplification of the manufacturing of the base member in that the sides of the wrapping are glued directly to the inserts, in which case however glue tongues can be present at the recesses for the forks and at the ends of the base members.

The specific forms elucidated in FIGS. 10–19 are preferred embodiments of a base member according to the invention. The inserts shown in FIG. 2 and 3 are, as mentioned above, standing, whereas the inserts shown in FIG. 10 and the following can be regarded as "lying" and the number of inserts in a base member is decreased to a minimum as compared to the embodiment shown in FIG. 3. The inner space of the base member contains preferably at the side of and between the recesses for the forks preferably one single lying insert. The space above the recesses for the forks also contains lying inserts.

The said inserts are suitably so located that the sides thereof which have tongues glued to each other are present in the bottom part of the base member which will strengthen the corresponding parts of the base member. In a special embodiment a base member according to the invention contains a long lying insert which essentially fills the space below the plane for the holes for the tubes and above the plane for the recesses for forks along the whole of the base member. In this case the other parts of the inner space of the base member can be filled with inserts as mentioned above, which can be lying or standing. Such an embodiment is elucidated in FIG. 17.

With the purpose to save material the wrapping can according to the invention be strengthened (made thicker) at the parts thereof on which the greatest stress will occur, viz. between and past the holes for the tubes down to and suitably past the edge for the recesses for the forks. This can be made either by adding one or several extra layers when the web-formed laminate is manufactured or by gluing of a separately manufactured sheet, suitably before the pressing step.

The base member illustrated in FIG. 10 consists of a wrapping 11, folded to the U-form with downwards directed side-walls 12; in the end part of the base member and in the middle thereof there are inserts 13 and 14 and above the recesses for the forks inserts 15. The inserts reach up to the plane for the holes and can support the underside of the tubes. The side-walls 12 of the wrapping is glued to the inserts. The lower surface of the inserts contains the two glue tongues on . the inserts. In the holes the optionally present friction inserts 24 are indicated.

FIG. 11 is a cut in the plane g in FIG. 10 and FIG. 12 is a cut in the plane h in FIG. 10. The figures show inserts 13 and 15 resp. which are glued to the inner surfaces of the wrapping.

FIG. 13 is an alternative to the embodiment according to FIG. 12 for the lower carrying surface at the recesses for the forks. In this case there are a pair of glue tongues 25 on the wrapping. Optionally also here inserts can be introduced of anyone of the previously mentioned types.

FIG. 14 is a section of a modified base member, the wrapping of which has been provided with a strengthening layer 16, which runs over the backbone and down to the holes for the tube$ and suitably some distance past the same. In the form shown the inserts do not reach up to the tubes 26. This strengthening layer can, of course, also be attached to the outside of the wrapping.

FIG. 15 is a section similar to the one shown in FIGS. 11 and 14 and shows how an insert 17 (in similarity with other inserts in the base member) in a base member with the same wrapping as in FIG. 14 can reach up to the tubes and optionally support the same. This can be made with a minor deformation of the insert. When the strengthening layer 16 is located on the outside as indicated above such deformation is however avoided.

It should be pointed out that the thickness of the laminates in the drawing figures for the case of clarity has been exaggerated and is thus not according to scale. The most commonly used laminate has a thickness of about 2.0 mms.

FIG. 16 shows a specific embodiment of a base member according to the invention, which base member contains one single insert 18 in one piece, which has been pressed to the intended form and provided with glue tongues on all surfaces directed downwards. Outsides of this insert the wrapping 12, folded to a U-form, is glued with the side-surfaces to the insert 18. The form shown can also be provided with a strengthening layer 16 over the backbone and the surfaces with holes as shown in FIG. 5.

FIG. 17 shows a further embodiment of a base member according to the invention, which in the space below the plane of the holes and above the plane for the recesses for forks contains an insert 19 running along the whole length of the base member. The empty spaces below this insert can be filled with further inserts 20, 21, 22 with glued tongues on surfaces directed downwards in case the wrapping has not been provided with such. The side-walls 12 of the wrapping are glued to the insert. Also this embodiment can be provided with a strengthening laminate layer 16 as has been shown in FIG. 15.

FIG. 18 shows an alternative embodiment of an insert consisting of an initially plane material layer folded to the formation of surfaces 24 in the same plane, to which the wrapping is glued, and perpendicular strengthening material surfaces 23. In the insert there are holes 8 for the tubes, which of course should be located as the holes in the wrapping. In the shown form there are surfaces 27, which close the end surfaces of the base member. In this embodiment for the insert the wrapping must of course be provided with glue tongues on the surfaces directed downwards.

In all the embodiments shown (except the one in FIG. 18) the base members have been shown with open transversal surfaces. These can of course, if required, be closed by glue tongues as has been shown for instance in FIG. 1 and FIG. 2.

FIG. 19 shows an especially preferred embodiment of a base member according to the invention. The base member shown consists of a wrapping folded to the U-form and in the parts located at the sides of the recesses for the forks box-formed inserts are present which fill the whole height from the bottom up to the inner upper surface 5 of the base member. A partially completed insert of this type is shown in FIG. 20, wherein 31 refers to the insert per se and 32 is the part of the insert which shall be folded for closing the opening of the insert with the glue tongue 33 which is glued to the opposite inner vertical surface thereof This insert is provided with prolonged tongues 30, which in the shown embodiment are glued to the inner upper surface 5 of the wrapping above the recesses for the forks for strengthening this part. In the part between the recesses for forks the insert present therein is provided with double such tongues 30 which are so prolonged that they meet the corresponding glue tongues 30 from the inserts present in the end parts of the base member.

Above the recesses for forks there are, according to this embodiment, no separate inserts but integral inserts formed by folding the wrapping in such a manner as is shown in FIG. 22, which shows a cut in the said part of the base member. In FIG. 22 5 is as before the upper surface of the wrapping, 11 is the side-surfaces of the wrapping, which are prolonged to glue tongues which pair-wise overlap each other, of which the upper one is prolonged to the formation of a diagonal part 34 which runs diagonally up towards the opposite upper corner for strengthening this part of the base member. The previously mentioned glue tongue 30 from the insert 31 is also shown.

FIG. 21 shows finally the cross-support inserted in the separate inserts in the embodiment for the base member according to FIG. 19, as well as holes for the tubes. These cross-supports can be so dimensioned that the desired friction between the base member and the tubes is obtained without the aid of friction inserts or similar devices.

A preferred carton material for the preparation of the laminate for the base members according to the invention is hydrophobic polyethylene-laminated carton with the thickness indicated above. Pallets are often stored outdoors under moist conditions. The preferred laminated carton material is per se not water-absorbing, for instance due to the polyethylene layer present on the outer surface. A certain slow absorption of water can occur at the edges of the laminate. This can however be prevented by application of a moisture barrier on these edges. As a moisture barrier numerous different known materials can be used, such as fats, waxes, suitably in a molten state so as to avoid the use of solvents. It is preferred to use the glue used for the lamination for this purpose.

The lower surfaces of the base members which rest on the ground or the floor, can for strengthening of the water-resisting layer, be provided with a more wear-resisting surface coating, if so is required. Such a coating may consist of anyone of numerous different materials such as an extra layer of the laminate used for the base member, a thicker layer of polyethylene or similar material attached to the surface by melting or similar.

The invention has been described above with reference to specific embodiments. It is obvious that other combinations of inserts and strengthenings can be made. Such combinations or modifications are obvious to the expert on the basis of the guidance and information given above.

We claim:

1. A base member for use in combination with one or more other members and tubes to provide a pallet of the type which consists of at least two elongate similar and essentially parallel base members through which tubes are transversely inserted to form the pallet, the base members being provided with means enabling engagement by the forks of a fork lift truck for lifting the pallets, the base members having upper and lower walls with flat exterior and interior surfaces and vertical parallel side walls with flat exterior surfaces, the side walls being apertured to provide a number of holes disposed through and in a direction perpendicular to the parallel side wall surfaces distributed along and with all of said holes being located closer to the upper wall surfaces of the base members than to their lower wall surfaces, the holes enabling tubes to be introduced therethrough with a friction fit so as to unite the base members to each other and enable the formation of a pallet, said means enabling engagement by the forks of a fork lift truck being recesses provided in the lower parts of the base member enabling passage of the forks of a fork lift truck transversely through the lower portion of said base member, the improvement being characterized in that the bases member comprises a pressed and folded flat wrapping material (11) which, after folding, constitutes a substantially hollow member defining an interior space including an interior space above said recesses and forms at least the aforesaid upper, lower and side walls and exterior surfaces (5,6,7,12) of said base member, that uppermost portions of at least some of the holes through said side walls are essentially coextensive with the interior surface of the base member upper wall and that stiffening parallelepipedical inserts (a–f, 13–23, 31) are included in substantially all part of the interior space of the folded hollow wrapping member, including the interior space above said recesses, which inserts are adapted to the interior dimensions of the wrapping, and bonding means are provided which bond said inserts at least to opposite inner sides of said wrapping.

2. Base member according to claim 1, characterized in that the inserts in the parts of the base member which touch the floor are box-formed with preferably all surfaces closed by pairs of glue tongues (33) in a conventional manner and that they are extended from the base surface up to the inner upper surface of the wrapping; and that the body-formed inserts are provided with holes for the tubes; and that the box-formed insert has at least one tongue (30) which is extended to a surface on the wrapping above the recesses for the forks and is bonded to the wrapping.

3. Base member according to claim 1, wherein the wrapping (11) is pressed from a web-formed material such as folding board.

4. Base member according to claim 1, wherein the wrapping (11) is pressed from a web-formed material such as solid board.

5. A pallet prepared with the use of at least two parallel spaced apart base members, each of which is made according to any one of claims 1, 2, 3 or 4, said pallet including at least two tubes transverse to said base members and friction fit in associated holes in said respective base members, which holes have their uppermost portions essentially coextensive with the interior surface on the associated base member upper wall.

* * * * *

UNITED STATES PATENT AND TRADEMARK OFFICE

CERTIFICATE OF CORRECTION

PATENT NO. : 4,834,001

DATED : May 30, 1989

INVENTOR(S) : FRED ATTERBY et al.

It is certified that error appears in the above-identified patent and that said Letters Patent is hereby corrected as shown below:

ON THE COVER SHEET

In the address of the inventor, Bertil Voss-Schrader, the city should be --Värdmö--.

In the Foreign Patent Documents, French Patent No. 141,828 should be --1418284--.

IN THE SPECIFICATION:

Column 2, line 35, after "Fig. 5" insert --shows--.

Column 2, line 39, after "holes" insert --having--.

Column 7, line 30, "tube$" should read --tubes--.

IN THE CLAIMS:

Claim 1, column 10, line 22, "part" should be --parts--.

UNITED STATES PATENT AND TRADEMARK OFFICE

CERTIFICATE OF CORRECTION

PATENT NO. : 4,834,001

DATED : May 30, 1989

INVENTOR(S) : Fred Atterby et al

It is certified that error appears in the above-identified patent and that said Letters Patent is hereby corrected as shown below:

Claim 2, column 10, line 23, "body-formed" should be --box-formed--.

Signed and Sealed this

Thirteenth Day of March, 1990

*Attest:*

*Attesting Officer*

JEFFREY M. SAMUELS

*Acting Commissioner of Patents and Trademarks*